United States Patent [19]

Claassen

[11] Patent Number: 4,744,330

[45] Date of Patent: May 17, 1988

[54] DEVICE FOR INTERMITTENT APPLICATION OF LIQUIDS SUCH AS ADHESIVE

[76] Inventor: Henning J. Claassen, Industriegebiet Hafen, 2120 Luneburg, Fed. Rep. of Germany

[21] Appl. No.: 937,859

[22] Filed: Dec. 4, 1986

[30] Foreign Application Priority Data

Dec. 4, 1985 [DE] Fed. Rep. of Germany ..... 3542903

[51] Int. Cl.[4] ..... B05C 5/02

[52] U.S. Cl. ..... 118/410; 118/704

[58] Field of Search ..... 118/410, 411, 764; 425/113

[56] References Cited

U.S. PATENT DOCUMENTS 3,126,574 3/1964 Fox ..... 118/411
4,535,719 8/1985 Regan ..... 118/410

FOREIGN PATENT DOCUMENTS 1115121 10/1961 Fed. Rep. of Germany ..... 118/410
1163650 2/1964 Fed. Rep. of Germany ..... 118/410
597928 4/1978 Switzerland .

*Primary Examiner*—John P. McIntosh
*Attorney, Agent, or Firm*—Armstrong, Nikaido, Marmelstein & Kubovcik

[57] ABSTRACT

A device for intermittent application of liquids such as adhesive, in particular hot-melt adhesive, to material moved relatively to the device, comprises a reservoir for the liquid, an application nozzle which is preferably formed as slit nozzle or a plurality of adjacent application passages, a supply line from the reservoir to the nozzle, a needle valve provided shortly upstream from the nozzle, a means for interrupting the flow from the reservoir to the nozzle at desired intervals, a return line to the reservoir connected to the supply line upstream from the main valve and a second needle valve for shutting off the return line. The second needle valve is larger than the main valve and lies as preliminary valve in the supply line a small distance upstream from the main valve; both valves are controllable in adjustable time relationship with respect to each other.

6 Claims, 1 Drawing Sheet

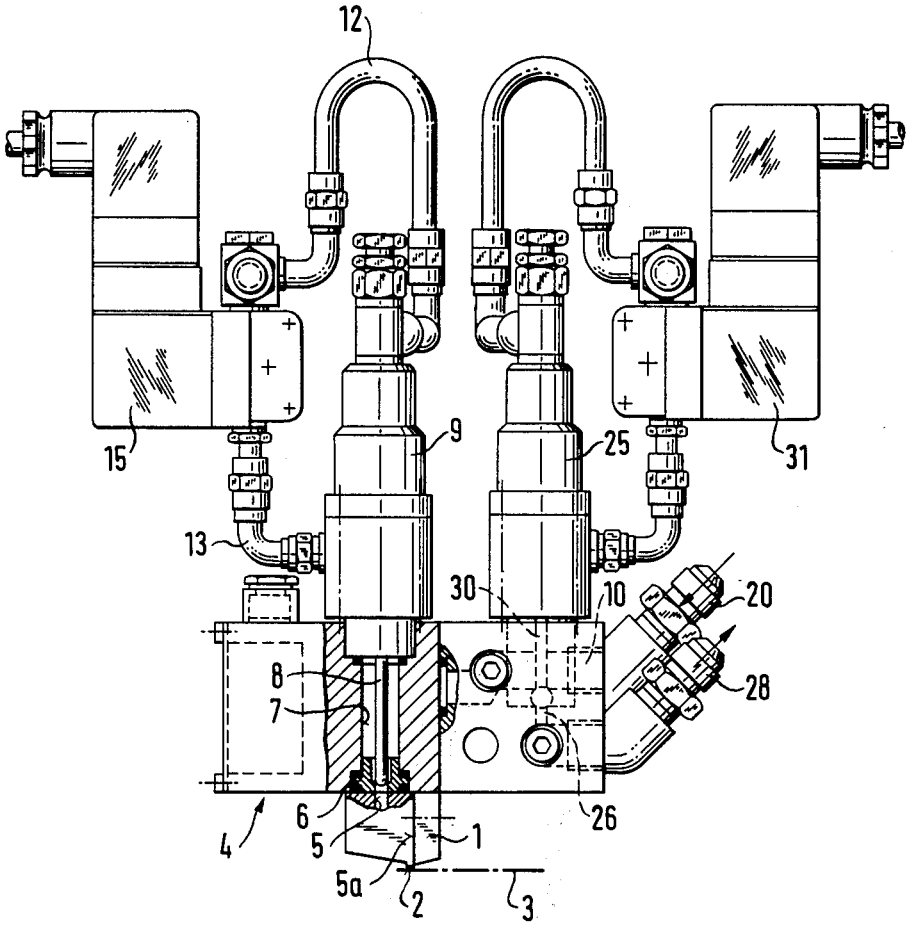
12
15
9
25
31
13
30
10
20
28
8
7
6
5
5a
2
1
4
26
3

DEVICE FOR INTERMITTENT APPLICATION OF LIQUIDS SUCH AS ADHESIVE

BACKGROUND OF THE INVENTION

1. Field of the Invention

The invention relates to a device for the intermittent application of liquids, such as adhesive, in particular hot-melt adhesives comprising valve means for interrupting the flow of the liquid from a reservoir to a nozzle. The device according to the invention is particularly suitable for applying viscous material such as molten hot-melt adhesive.

2. Description of the Prior Art

Such devices are widely known. The valve means consists in many such known devices of a simple shutoff valve which is intermittently opened and closed. With such a construction problems arise in so far as upon opening the valve means, which to avoid large accumulations of liquid between valve and discharge opening should be disposed close to the discharge opening of the application nozzle, in the line between the reservoir and the valve the full pressure of the supply pump undiminished by dynamic pressure losses builds up.

When the valve is now suddenly opened, as is required with rapid applications with high interruption frequency, a relatively large amount of adhesive shoots out at the start of the application onto the material to be coated so that there the coating becomes undesirably thick. Also, with increasing relative speed between the material to be coated and application nozzle the start and the end of the coating becomes continuously less clean. To obviate the first difficulty the simple shutoff valve in the adhesive supply line has already been replaced by a valve means which operates by the principle of a three-way cock and in which in the application-free time the adhesive in the supply line is not stationary but flows back via a return line which is opened whenever the adhesive supply to the nozzle is closed. Admittedly, in this manner the constant change between full backpressure and dynamic pressure in the nozzle region is avoided. However, even with such a valve design the cleanness of the start of the application is in need of improvement, in particular at high frequencies of the application interruptions and high relative speed between web and application nozzle.

SUMMARY OF THE INVENTION

The invention therefore has as its object the provision of a device of this type with which even with very rapid web movement and high working frequency of the valve means an optimally dimensioned application takes place in particular at the start and end of the application.

The invention therefore proposes in a device for intermittent application of liquids such as adhesive, in particular hot-melt adhesive, to material moved relatively to the device, comprising a reservoir for the liquid, an application nozzle which is preferably formed as slit nozzle or a plurality of adjacent application passages, a supply line from the reservoir to the nozzle, a needle valve provided shortly before the nozzle in the line for interrupting the flow from the reservoir to the nozzle at desired intervals, a return line to the reservoir connected to the supply line before the main valve, and a second needle valve for shutting off the return line, the improvement that the second needle valve is larger than the main valve and lies as preliminary valve in the supply line a small distance in front of the main valve and that both valves are controllable in adjustable time relationship with respect to each other.

Such a valve means makes it possible with the preliminary valve to control exactly in the desired sense the pressure conditions in the main valve both on opening and on closing and to achieve from the start to the end of the usually short application distance a constant coating thickness and also a clean starting and termination of the application coating.

If in accordance with a preferred embodiment the preliminary valve is made to close shortly after the opening of the main valve (the time delay is of course very small) then not only the normally occurring excessive application at the start of the application when only one valve is present is prevented. In addition, the start of the application takes place extremely uniformly and remarkably sharply as was hitherto not possible. By regulating the time interval practically any desired start of the application can be achieved.

According to a further preferred embodiment of the invention when the main valve is closed the valve remote from the nozzle is opened shortly beforehand (here as well the time displacement is very small). As a result, on closing of the main valve the last residue of the adhesive is discharged at lower pressure and this is particularly advantageous when the main valve is of the type, for example a needle valve, which on its closure movement in the flow direction exerts an additional thrust on the adhesive column following the needle valve. In addition, by the opening of the preliminary valve just before the closing of the main valve the pressure in the region between the exit slit of the nozzle and the main valve is reduced and this counteracts any form of subsequent dripping of the nozzle. This advantage is achieved irrespective of the type of main valve.

The length of the line from the preliminary valve to the main valve should be small. It is advantageously not much larger, but also not much smaller, than the path from the main valve to the nozzle exit opening and is advantageously three to six times this path.

According to a preferred further development of the invention at least one of the valves, preferably also the other, is a needle valve. Such needle valves have the great advantage that they are commercially available as complete units and moreover are also particularly well suited to the specific purpose here.

Since the valves in many cases must be actuated very rapidly the actuation is preferably pneumatic. If the pneumatic actuating pressure is made high enough and the areas subjected thereto large enough an extremely rapid and reliable valve actuation can be achieved.

Preferably, the pneumatically actuable valves carry on their stems differential pistons whose smaller face is continuously under pressure which keeps the valve closed or tends to close said valve, the larger face thereof being adapted to be subjected to pressure medium from the opposite side to open the valve.

The control of the valve actuation with pressure medium—usually compressed air—is preferably electromagnetic because in this manner a very accurate and rapid actuation of the valves is possible even with high frequency.

BRIEF DESCRIPTION OF THE DRAWING

The invention is described in more detail hereinafter with the aid of the preferred embodiment illustrated in the drawing.

The drawing shows a view of the device according to the invention from the side; for clarity the reservoir for hot-melt adhesive under pressure including the necessary delivery pump and the connecting lines to the application head have not been illustrated.

DESCRIPTION OF THE PREFERRED EMBODIMENT

The application head shown in the drawing carries at its lower side an application nozzle 1 which at 2 comprises an application slit which extends perpendicular to the plane of the drawing and from which hot-melt adhesive is to be applied intermittently to the material web indicated at 3. The material web is moved past beneath the application nozzle at a small distance therefrom of for example half a millimeter with a speed of for example 250 m/min. With the nozzle hot-melt adhesive is to be applied at intervals of for example 2 cm along a length of 4 cm.

The nozzle is screwed from below to the application head 4 which substantially supports and carries the valve means. In the partially sectioned nozzle the supply passage 5 for hot-melt adhesive can be seen, being closed at the top by a valve seat body 6 which is mounted in pressure-tight manner by means of O rings in a correspondingly stepped bore 7 of the head 4. The needle 8 of a main needle valve 9 extends vertically from the top to the bottom through said bore 7 and in its lowered position, which is illustrated in the drawing, closes the valve seat in the valve seat body 6 and in the raised state permits the flow of hot-melt adhesive through the horizontal line 10 to the supply passage 5. The needle valve 9 is the main valve. It is of commercially usual structure. The valve needle carries further above in a manner not shown a differential piston whose smaller upwardly directed face is subjected to the pressure of air which tends to push the valve needle downwardly into the valve seat and thus close the main valve. The compressed air is supplied for this purpose via the line 12 to the upper side of the cylinder of the differential piston control for valve 9. Through the line 13 air at the same pressure is supplied to the lower side of the piston, which is appropriately larger, so that when the air supply is switched from the line 12 to the line 13 the differential piston is abruptly raised and the valve thus opened in that the needle 8 is lifted off the valve seat 6. For reversing the compressed air supply from the line 12 to the line 13 and vice versa an electromagnetically actuated reversing valve 15 is used. Such electromagnetic reversing valves 15 for compressed air and the needle valve 9 are known and are consequently only described schematically here. The horizontal passage 10 indicated in dot-dash line in the right half of the application head 4 adjoins a connecting piece 20 to which an insulated supply hose, not shown, for hot hot-melt adhesive is secured. The other end of the supply hose is secured to the output of the pressure and conveying pump for the hot-melt adhesive. To enable the pump to continue running when the valve means is completely closed said pump is provided with a pressure-relief valve in the usual manner which when the pressure increases on the pressure side of the pump beyond a preset magnitude opens and allows the hot-melt adhesive to flow back into the reservoir for liquid adhesive.

Over the horizontal supply bore 10 a second needle valve 25 is disposed which has substantially the same structure as the valve 9 and is also actuated in the same manner by means of a magnetic valve 31. This valve means will thus not be described in detail as regards its structure and control.

From the horizontal supply bore 10 a vertical bore 26 extends downwardly and then bends to the right in the drawing and continues to the connecting piece 28 from which a pressure hose for excess hot-melt adhesive leads back to the reservoir for liquid adhesive. The entry of the bore 26 from the horizontal bore 10 is closed by the valve needle 30 of the second needle valve 25 which is made wider than the needle 8. The needle 30 is of course so dimensioned that it does not oppose the hot-melt adhesive flow in the bore 10 with excessive resistance. Likewise, the bore 26 is made large enough to permit return through the connecting piece 28 of the hot-melt adhesive supplied through the connecting piece 20 without undesirably high throttling.

The electromagnetic control valves 15 and 31 for the needle valves 9 and 25 are electromagnetically actuated at desired intervals of time. The control takes place in so far with the aid of a so-called microprocessor which can control with very high accuracy the opening and closing of the two needle valves 9 and 25 at the desired time intervals and displacements with respect to each other. In the preferred embodiment the microprocessor is programmed to close the valve 25 shortly after the main valve 9 is opened and to open the valve 25 shortly before the main valve 9 closes.

The application nozzle 2 is preferably of the type as described in applicant's patent application Ser. No. 934,963 for "SLIT NOZZLE" filed Nov. 25, 1986, and incorporated herein by reference and relating to such an application nozzle. In this nozzle the supply passage 5 bends to the right in the drawings within the nozzle body at about half the height thereof and then flows in the region of the separating joint **5*a* between the right and left portion of the nozzle body into a distributing chamber which extends in the drawing perpendicularly to the plane thereof and symmetrically with respect to the plane of the angled supply passage 5. From this dispersion or spreading chamber the hot-melt adhesive then moves downwardly perpendicularly through a slit of constant width and constant thickness to the exit opening from whence it applies itself to the web material 3**. The slit is formed by a milled recess in the left part of the nozzle body in the drawing whilst the spreading chamber is formed by a recess in the right part of the nozzle body so that the flow of the hot-melt adhesive in the horizontal direction first passes into the spreading chamber in which it expands in both directions perpendicularly to the plane of the drawing over the nozzle width, but it must then flow toward the bottom of the drawing to the region of the slit. Such a configuration has proved particularly advantageous.

The preliminary valve 25 can for example also be made as a three-way cock. For this purpose the needle thereof can have for example a thickening which with its lower end closes the line to the main valve and with its upper end closes the return line. This permits a still more accurate control of the pressure downstream from the preliminary valve.

I claim:

1. In a device for intermittent application of liquids such as hot-melt adhesive, to material moved relative to the device, including a reservoir for the liquid, an application nozzle, a supply line from the reservoir to the nozzle, a first needle valve provided upstream from the nozzle in the supply line for interrupting the flow from the reservoir to the nozzle at desired intervals, a return line to the reservoir connected to the supply line upstream from the first needle valve, and a second needle valve for shutting off the return line, the improvement comprising: said second needle valve being larger than the first needle valve and located as a preliminary valve in the supply line upstream from the first needle valve where the return line is connected to the supply line and wherein both valves are controllable in adjustable time relationship with respect to each other.

2. A device according to claim 1, wherein said first and second needle valves are pneumatically actuable.

3. A device according to claim 2, wherein said first and second needle valves carry on their stems differential pistons whose smaller face is continuously under pressure which keeps the valve closed or tends to close said valve and whose larger face is adapted to be subjected to a pressure medium to open the valve.

4. A device according to claim 1, wherein said first and second needle valves are electromagnetically controlled.

5. A device according to claim 1, wherein the preliminary valve closes shortly after the opening of the first needle valve.

6. A device according to claim 1, wherein the preliminary valve opens shortly before the closure of the first needle valve.

* * * * *